US006474011B1

(12) United States Patent
Sato

(10) Patent No.: US 6,474,011 B1
(45) Date of Patent: Nov. 5, 2002

(54) SECURED FIREARM

(76) Inventor: Takashi Sato, 39-5, Nokendai 3-chome, Kanazawa-ku, Yokohama (JP), 236-0057

( * ) Notice: Subject to any disclaimer, the term of this patent is extended or adjusted under 35 U.S.C. 154(b) by 0 days.

(21) Appl. No.: 09/907,270

(22) Filed: Jul. 16, 2001

(51) Int. Cl.[7] ..... F41A 17/00
(52) U.S. Cl. ..... 42/70.11; 42/70.08
(58) Field of Search ..... 42/70.11, 70.08, 42/66, 67

(56) References Cited

U.S. PATENT DOCUMENTS

| | | | | | |
|---|---|---|---|---|---|
| 3,735,519 | A | * | 5/1973 | Fox | 42/70 |
| 4,761,906 | A | * | 8/1988 | Guevara | 42/70.11 |
| 4,987,693 | A | * | 1/1991 | Brooks | 42/70.11 |
| 5,408,777 | A | * | 4/1995 | Brooks | 42/70.11 |
| 5,737,864 | A | * | 4/1998 | Otto | 42/70.11 |
| 5,913,666 | A | * | 6/1999 | Perkins | 42/70.11 |
| 6,235,480 | B1 | * | 7/2001 | Florez | 42/70.11 |
| 6,338,217 | B1 | * | 1/2002 | Viani | 42/70.08 |

* cited by examiner

*Primary Examiner*—Charles T. Jordan
*Assistant Examiner*—Danielle S. Rosenthal

(57) ABSTRACT

The present invention describes a secured firearm, including semi-automatic pistols and revolvers, which has a permanently mounted locking device 1 in front of a trigger guard 3 and under a barrel 4. The locking device 1 locks a locking bar 7 which restricts the movement of a slide 5 or a cylinder 30, thereby disabling the secured firearm. The locking device 1 is attached to the outside of the secured firearm. Therefor, the impact on the inside of the secured firearm can be minimized. Any kind of lock can be used as the locking device 1 as long as it is compact enough to be installed in the housing of the locking device 1. For example, a key lock, a combination lock, an electric lock, and a biometric lock such as fingerprint authentication are all applicable to the locking device 1. The locking device 1 is fixed to the secured firearm firmly with screws from inside of the frame, whereby unauthorized dismantling of the locking device 1 is prevented. There is no possibility that the locking device 1 is lost during the secured firearm is used. It does not contact a trigger nor a hammer. Therefore, there is no possibility of accidental firing of the secured firearm due to mishandling of the locking device 1. The locking device 1 is applicable to both current handguns and newly designed handguns.

10 Claims, 13 Drawing Sheets

SECURED FIREARM

BACKGROUND OF THE INVENTION

1. Field of the Invention

The present invention relates to firearms, including semi-automatic pistols and revolvers, which have a permanently mounted locking device in front of a trigger guard and under a barrel, whereby the locking device restricts the movement of a slide or a cylinder, thereby disabling the firearm.

2. Prior Art

Fear of accidental firings and particularly unauthorized use of firearms by students in school are growing in our society. There is a growing need for firearm locking devices. Many firearm locking devices have been proposed. However, there are few firearm locking devices which are really in use. There are two types of proposed firearm locking devices. One is a detachable firearm locking device. The other is an embedded firearm locking device.

A detachable firearm locking device is attached to a firearm only when it is used to secure a firearm. The most typical detachable firearm locking device is a trigger guard lock. U.S. Pat. No. 6,205,695 was issued to Schnell on Mar. 27, 2001. A detachable firearm locking device can be applied to current firearms without design change. However, it must be removed when a firearm is used. It is not a permanent component of a firearm. It must be detached and kept anywhere else while a firearm is used. Therefor, one can easily either forget to secure a firearm again or lose a trigger guard lock itself. Moreover, as stated above, the most typical detachable locking device is a trigger guard lock. It inherently requires access to a trigger. When you remove or install it, there is a certain risk that you might hit a trigger and fire accidentally if a gun is loaded. This risk is bigger than that of unauthorized use for many gun owners. A detachable firearm locking device rather inherently increases the potential risk of accidental firing. In order to avoid this risk, you need to keep a firearm unloaded whenever you lock a firearm. Therefor, you always need to load a firearm again whenever you unlock a firearm. This means that you cannot use a firearm as soon as possible after unlocking a firearm. You cannot keep a firearm standby position safely with a trigger guard lock.

An embedded firearm locking device is embedded in a body of a firearm such as a grip or a frame. Typical of an embedded firearm locking device is U.S. Pat. No. 5,743,039 issued to Garrett on Apr. 28, 1998. It is a permanent component of a firearm. You need not remove it when you use a firearm. There is no possibility of losing it while you are using a firearm except a key. If a combination lock is embedded, you don't need a key itself. It is less possible that you forget to secure a firearm after you use it. However, it requires a lot of space within a firearm. Any kind of handgun type firearms is designed very tightly and functionally. They do not have any room to embed an additional locking device such as a combination lock. Therefore, an embedded locking device requires major design change of a firearm. There are two problems. One is that you cannot install an embedded locking device in a current handgun as it is. An embedded locking device is not applicable to any current handguns. There are already a large number of handguns in the society which impose a large risk to the society. An embedded type firearm locking device cannot solve this issue. The other problem, which is much more critical, is that an embedded locking device is not practicable even for a newly designed handguns. An embedded locking device causes a very strong space conflict with other major components of a handgun and thereby destroy the best balance of a handgun. The best balance of a handgun is very important because if it is lost shooting rate must be deteriorated. This is one of the main reasons why there is no embedded locking device used actually for handgun design. There are many patent figures which disclose concepts of embedded firearm locking devices. However, none of them are drawn correctly in scale. They are drawn as if a handgun still kept the original proportion and balance although an embedded locking device is embedded in the body of a handgun. This does not lose the feasibility of the patents as a concept. However, no gun makers adopt them for actual handgun design because they are not feasible in reality if the original proportion and the best balance of a handgun are kept. For example, in the case of pistols, most concepts embed a combination lock into a grip. However, there must be a certain space in a grip for a magazine. Therefore, if a combination lock is embedded in a grip, the size of a grip must be enlarged. As a result, one cannot hold the pistol with the original best balance and get worse shooting rate. Another embedded firearm locking device patent was issued to Granaroli on Oct. 3, 2000 as U.S. Pat. No. 6,125,568. This former example embeds a combination lock into a frame of a pistol at the upper portion of a trigger guard. However, there is a recoil spring assembly in that portion of a frame. In order to avoid the conflict between a combination lock and a recoil spring assembly, you need to increase the height of a frame. The patent figure was drawn out of scale. The figure is depressed in the height direction. The diameter of the barrel is unreasonably too small and the front surface of the frame is drawn as a square which must be rectangular in reality. As a matter of fact, the embedded combination lock must increase the height of the pistol. Height increase makes a gun unstable. As a result, you lose the best balance of a pistol and get wore shooting rate.

Yet another U.S. Pat. No. 5,782,029 was issued to Brooks on Jul. 21, 1998. This former example embeds a combination lock at the bottom of a magazine. This is to prohibit unauthorized withdrawal of the magazine. However, if it is already loaded you cannot prohibit unauthorized firing. You can never prevent this type of unauthorized firing of a pistol if the magazine is already loaded. In order to avoid this risk, you need to keep the pistol unloaded whenever you lock the magazine. Therefor, you always need to load the pistol again whenever you unlock the magazine. This means that you cannot use the pistol as soon as possible after unlocking the magazine. You cannot keep the pistol standby position safely with the magazine lock. Moreover, the magazine itself is detachable if the lock is released. And you can easily replace the magazine with a conventional one. Another type of this locking magazine has a concept to prohibit the movement of a trigger. However, this concept requires a certain increase of size of a magazine. This also results in a larger grip size and losing the best balance of the pistol.

BRIEF SUMMARY OF THE INVENTION

The present invention describes a secured firearm, including semi-automatic pistols and revolvers, which has a permanently mounted locking device in front of a trigger guard and under a barrel, whereby the locking device restricts the movement of a slide or a cylinder, thereby disabling the secured firearm. The locking device is attached to the outside of the secured firearm. Therefor, the impact on the inside of the secured firearm can be minimized. Any kind of lock can be used as the locking device as long as it is compact enough to be installed in the housing of the locking device. For example, a key lock, a combination lock, an electric lock, and a biometric lock such as fingerprint authentication are all applicable to the locking device.

A primary object of the present invention is to provide a secured firearm which has a permanently mounted locking device nevertheless without losing the best balance of a firearm.

Another object of the present invention is to provide a secured firearm having a locking device which is applicable to current handguns without major design change.

Yet another object of the present invention is to provide a secured firearm having a locking device which does not require removal of itself for the use of a firearm.

Yet another object of the present invention is to provide a secured firearm having a locking device which does not require any access to a trigger nor a hammer and has no risk increase of accidental firing due to mishandling of the locking device.

The present invention overcomes the shortcomings of the prior art by providing a firearm with a locking device that can be permanently mounted on a frame without losing the best balance of a firearm nor requiring major design change inside of a firearm.

BRIEF DESCRIPTION OF THE DRAWINGS

In order that the invention may be more fully understood, it will now described, by way of example, with reference to the accompanying drawings in which.

DETAILED DESCRIPTION OF THE INVENTION

Figure 1:
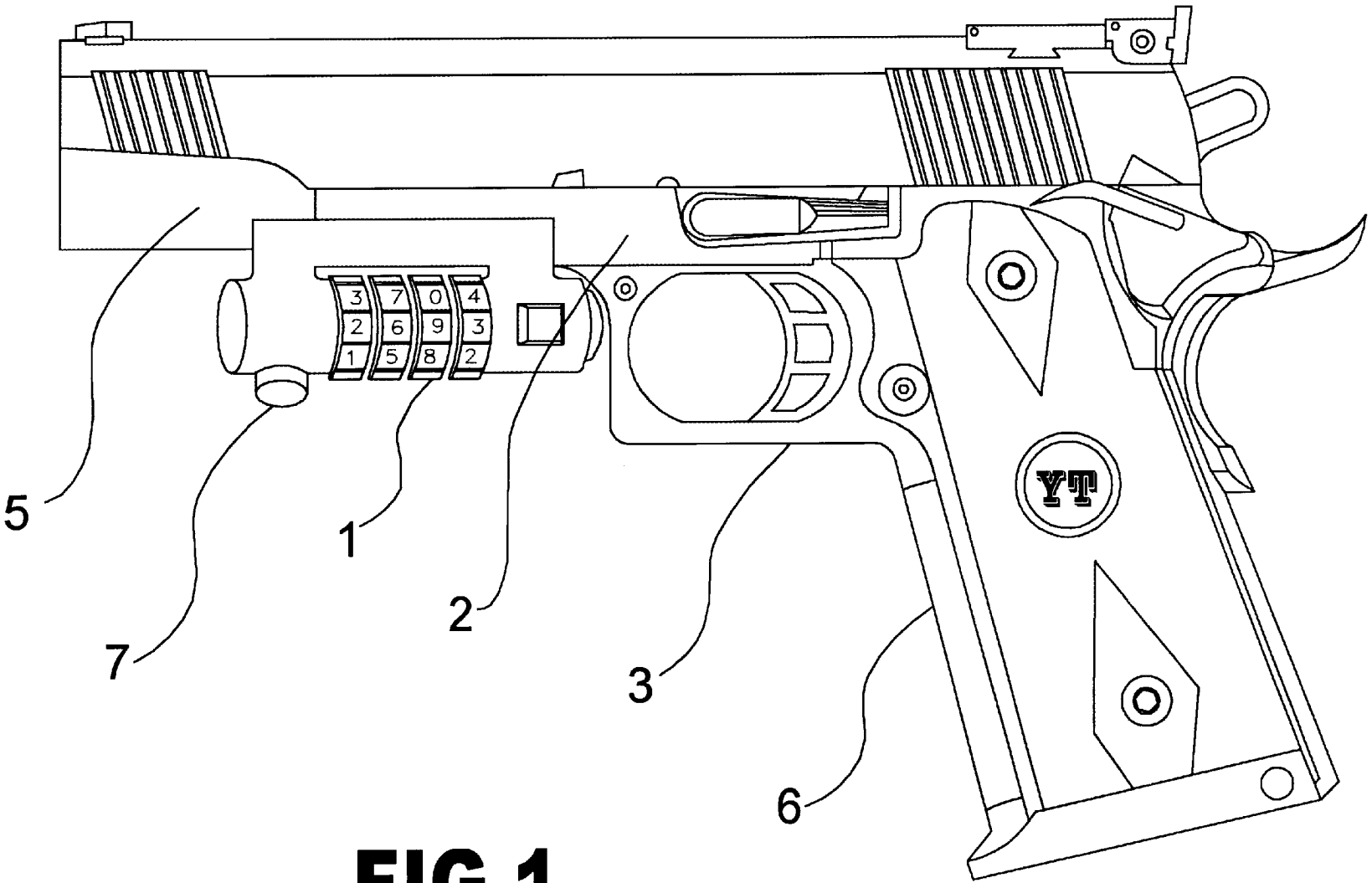
FIG. 1 is a side view of one embodiment of a secured firearm in the case of a pistol or a semiautomatic handgun according to the present invention.

Turning now descriptively to the drawings, in which similar reference characters denotes similar elements throughout the several views. With regard to the reference numerals used, the following numbering is used throughout the various drawings.

1 locking device
2 frame
3 trigger guard
4 barrel
5 slide
6 pistol
7 locking bar
8 locking pin
9 release button
10 inner screw
11 inner screw
12 slide stop
13 side wall screw
14 side wall screw
15 dial disk tumblers
16 lock housing
17 equipment rail
18 equipment rail
19 signal receptor
20 chip
21 solenoid
22 solenoid
23 battery
24 attachment rail
25 attachment rail
26 biometric CMOS sensor
27 fiber-optic surface
28 signal and power cables
29 revolver
30 cylinder
31 current yoke
32 cylinder rod
33 curved yoke
34 inner screw
35 screw
36 arm
37 cylinder rod shroud Preferred embodiments of the secured firearm in the case of a semiautomatic handgun according to the present invention will be described hereunder with reference to FIG. 1 through FIG. 7B.

Referring to FIG. 1, therein is shown a side view of one preferred embodiment of the present invention in the case of a semiautomatic handgun where a locking device 1 is fix to a frame 2 in front of a trigger guard 3 and under a barrel 4. The barrel 4 is installed inside of a slide 5 and not shown in the view. The locking device 1 exists outside of a pistol 6. Therefore the locking device 1 does not cause any major design change inside of the pistol 6. Normally an optional weight is fixed to this portion, namely, in front of a trigger guard and under a barrel, to improve the balance of a pistol. An optional weight fixed to this portion can minimize the kickback of a pistol. Therefore, the locking device 1 can also improve the balance of the pistol 6 and results in better shooting rate. Any kind of lock can be used as a locking device 1. In this embodiment, said locking device 1 is a combination lock where a sequence of 4 figures is used for key information. In the locked position, a locking bar 7 is held at the upper position, and it restricts the movement of a slide 5. If the slide 5 cannot slide back, the pistol 6 cannot load a bullet and get disabled. Only if the sequence of 4 figures is ordered correctly, the locking device 1 can be released and the locking bar 7 can be withdrawn below and inserted upward. If the locking bar 7 is withdrawn below, the pistol 6 is in released position. In this released position, the slide 5 can slide back and a bullet can be loaded. In this situation, the pistol 6 can work exactly in the same manner as a current one works. If the sequence of 4 figures is changed, the locking bar 7 cannot be inserted upward. This can prevent inadvertent insertion of the locking bar 7 when the pistol 6 is in operation. This can also prevent disclosure of the hidden sequence of 4 figurers when the pistol 6 is in operation.

Figure 2:
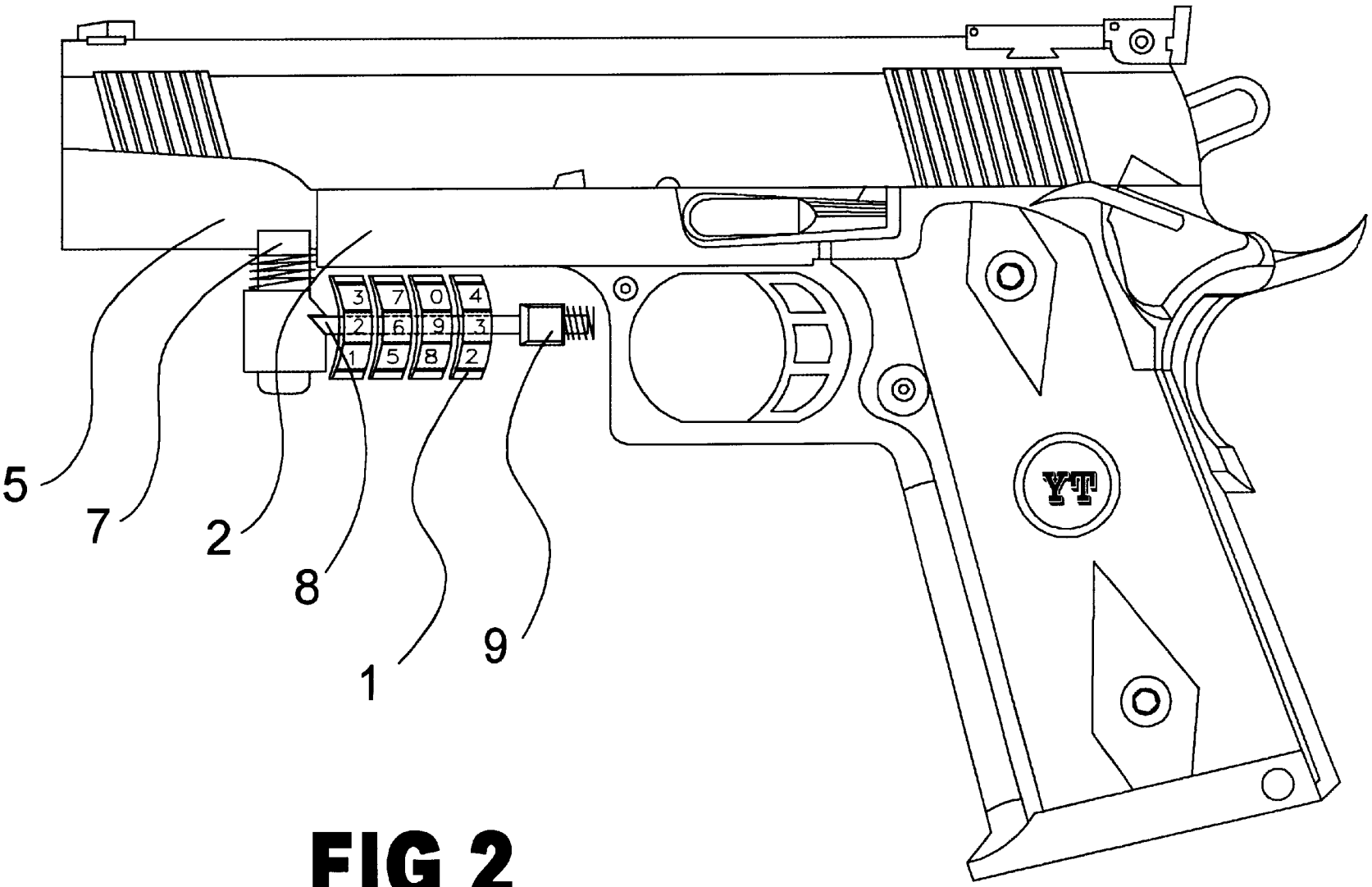
FIG. 2 is a side view showing the inside of a locking device.

Turning to FIG. 2, therein is shown the inside mechanism of the locking device 1. In the locked position, the locking bar 7 is inserted into a hole of the slide 5. Said hole is not shown in the view. If the slide 5 is pulled back, the slide 5 pushes the locking bar 7 against the front end of the frame 2, whereby the movement of the slide 5 is restricted and strong force to the locking device 1 can be avoided. The locking bar 7 is fixed by a locking pin 8. If the sequence of the combination lock is ordered correctly, the locking pin 8 can be pulled back by a release button 9.

Figure 3:
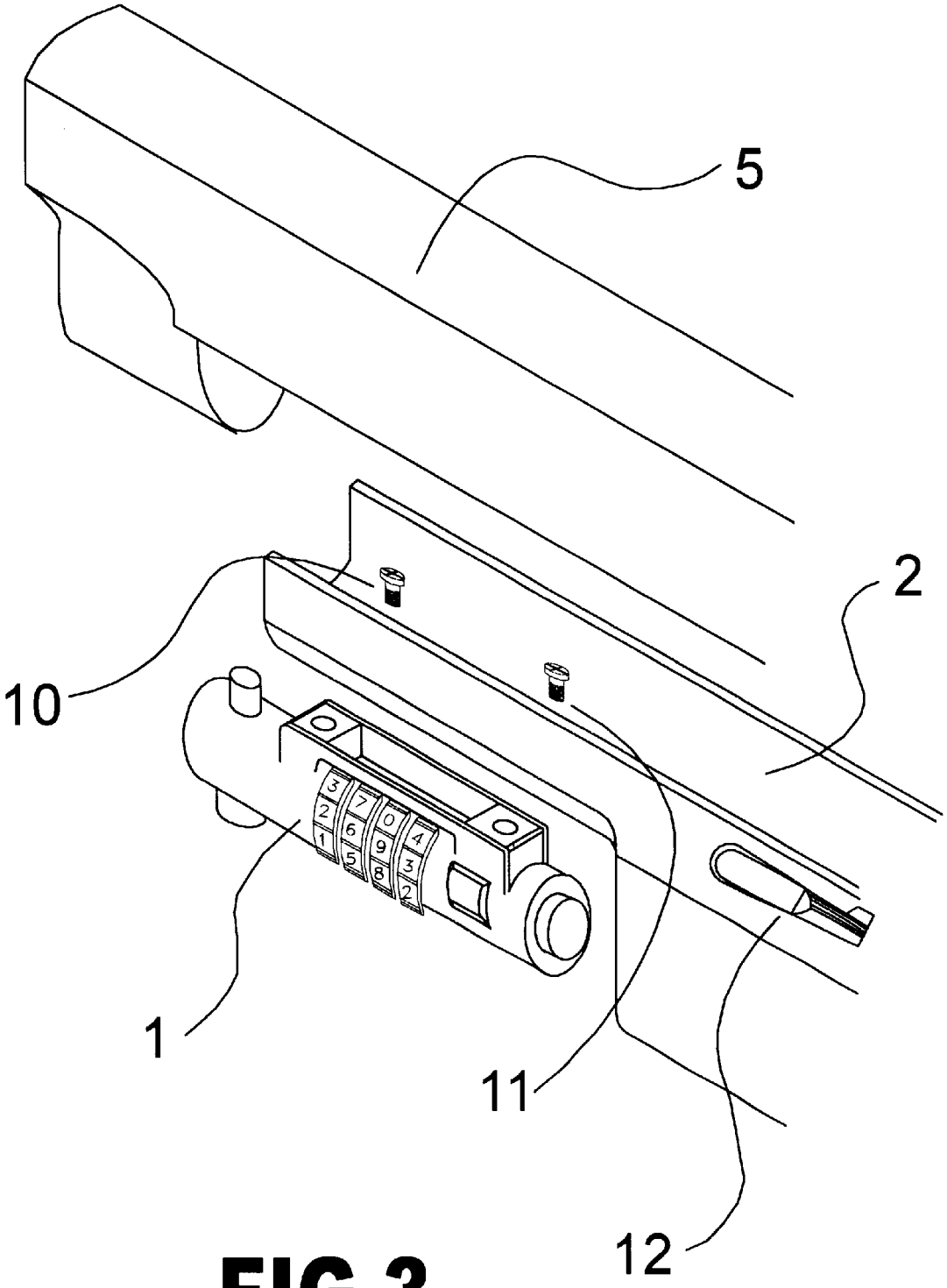
FIG. 3 is a perspective view showing the way by which a locking device is mounted permanently to a frame of a pistol.

Turning to FIG. 3, therein is shown the way how to fix the locking device 1 to the frame 2. As can be seen, two inner screws 10, 11 fix the locking device 1 from the inside of the frame 2. Normally, a slide 5 covers the frame 2. In order to tighten or loosen the inner screws 10, 11, you need to remove the slide 5 at first. In order to remove the slide 5, you need to pull the slide 5 backward and withdraw the slide stop 12. In order to pull the slide 5 backward, the locking device 1 must be released. If the locking device 1 is in the locked position, you cannot pull back the slide 5 nor withdraw the slide stop 12. You cannot remove the slide 5. Therefor, you can never dismantle the locking device 1, unless you know the hidden key code for the locking device 1.

Figure 4:
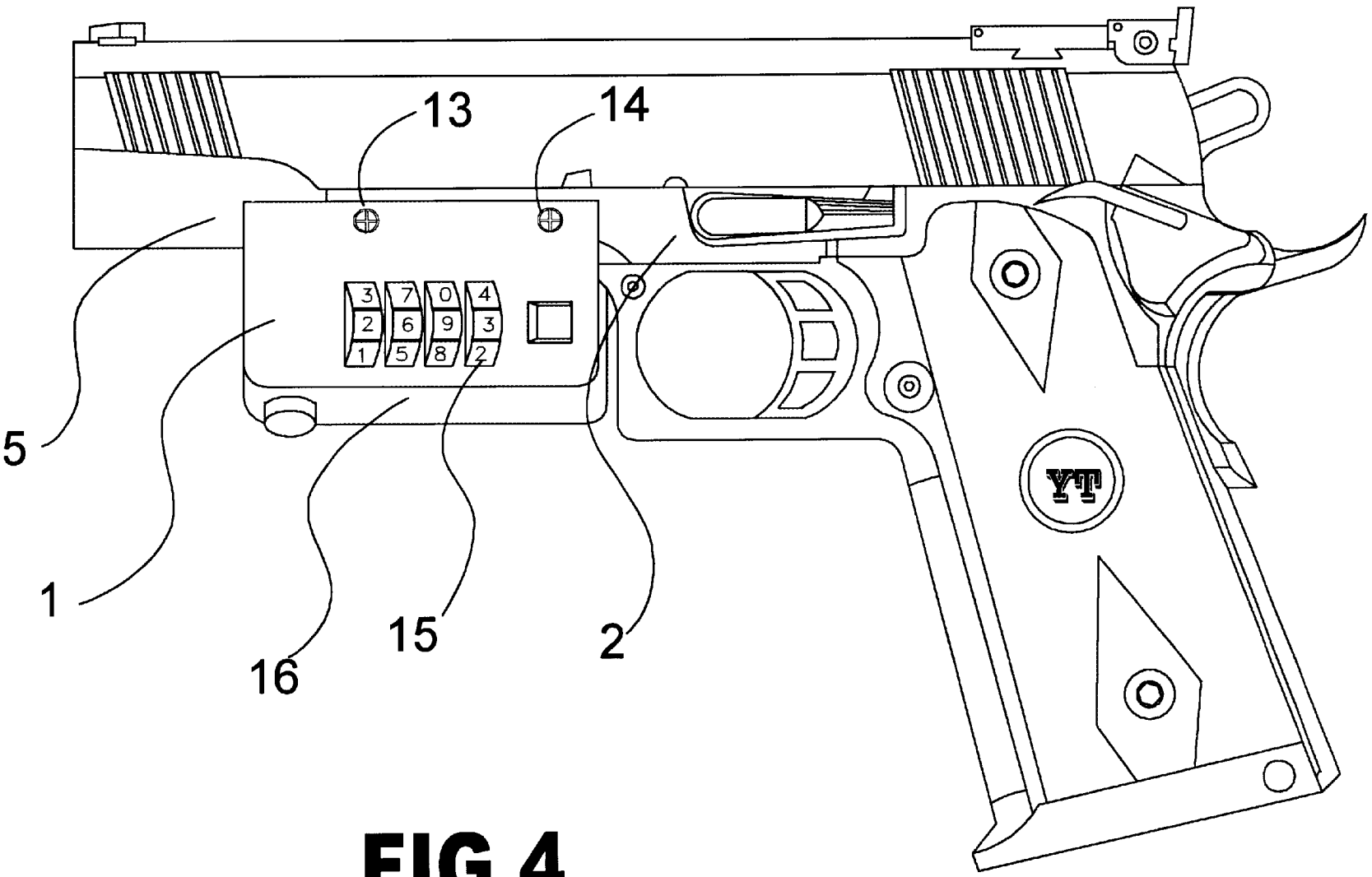
FIG. 4 is a side view of one embodiment of the invention in which side wall screws fix a locking device to a frame firmly in the case of current pistols.

Turning to FIG. 4, therein is shown the way how to fix the locking device 1 to the frame 2 more firmly in the case of current pistols. As can be seen, side wall screws 13, 14 also fix the locking device 1 to the frame 2. Dial disk tumblers 15 are installed in a lock housing 16. Inner screws 10, 11 also fix the locking device 1 to the frame 2. You can also weld the lock housing to the frame 2 if necessary.

Figure 5A:
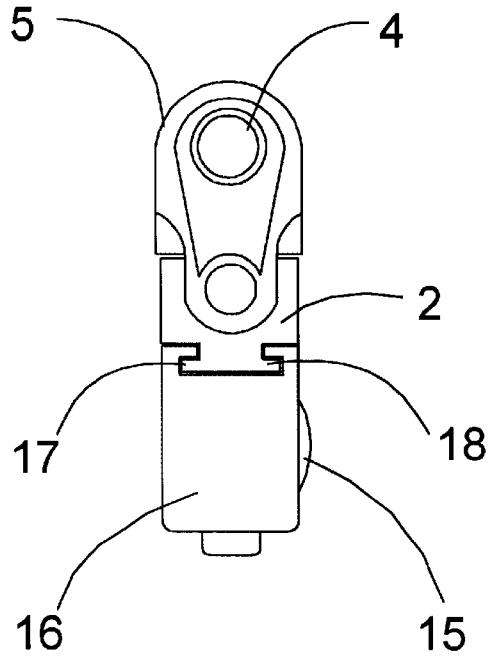
FIG. 5A is a front view showing the front end of a pistol which has equipment rails on the both sides of a frame. A locking device can be firmly connected on the equipment rails in the case of newly designed pistols.

Turning to FIG. 5A, therein is shown the front views of one preferred embodiment for newly designed secured firearms according to the present invention where the dial disk tumblers 15 are mostly covered by a lock housing 16. As can be seen, there are equipment rails 17, 18 on the both sides of a frame 2. A locking device 1 can be firmly connected on the equipment rails 17, 18 in the case of newly designed pistols. Inner screws 10, 11 which are not shown also fix the locking device 1 to the frame 2.

Figure 5B:
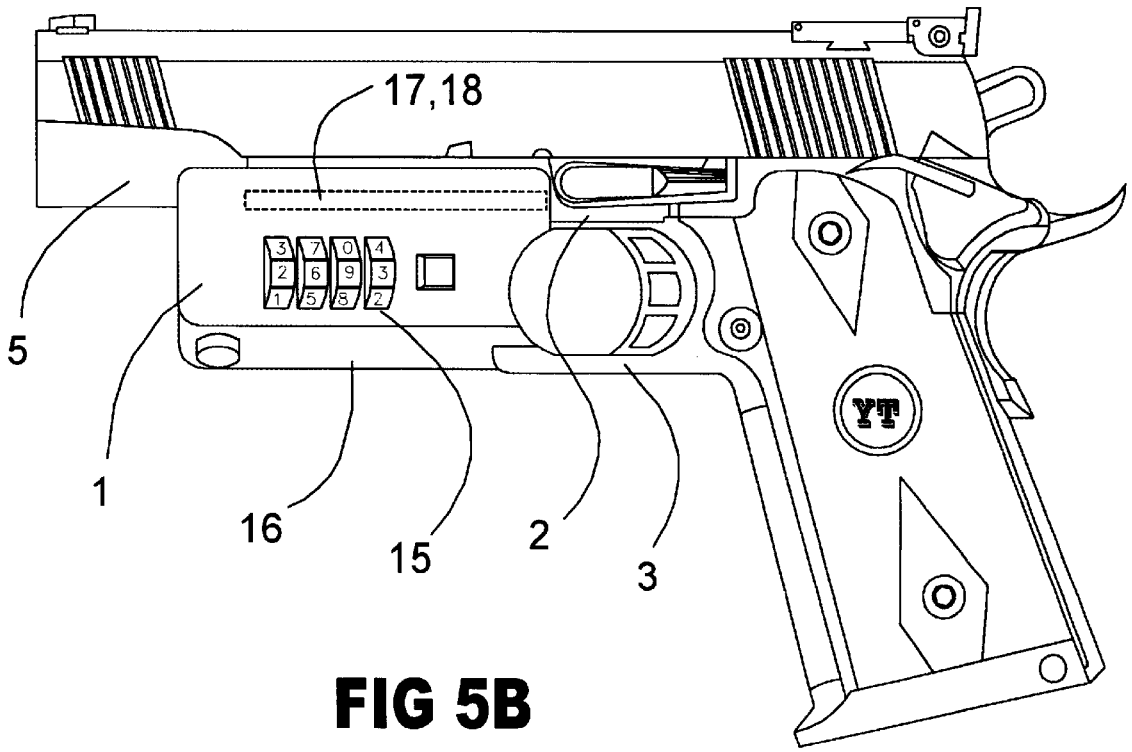
FIG. 5B is a side view showing one embodiment according to the invention corresponding to FIG. 5A.

Tuning to FIG. 5B, therein is shown a side view of one preferred embodiment for newly designed secured firearms according to the present invention where the disk tumblers 15 are mostly covered by a lock housing 16. The lock housing 16 is mounted on equipment rails 17, 18 though said rails 17, 18 cannot be seen from this direction. Said lock housing 16 also holds a trigger guard 3. Therefor, the locking device 1 is very firmly fixed to a frame 2. Inner screws 10, 11 which are not shown also fix the lock housing 16 to the frame 2. In order to avoid unauthorized dismantling, you can weld the lock housing 16 to the frame 2. You can also make an extended frame which originally include the lock housing 16.

Figure 6A:
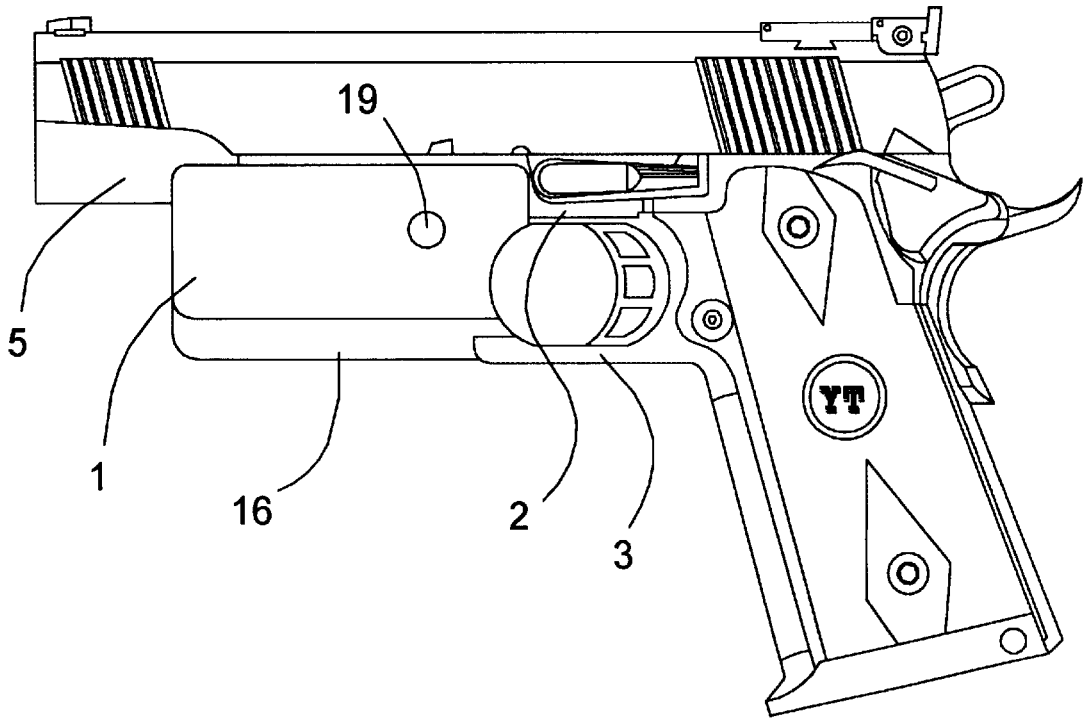
FIG. 6A is a side view showing one embodiment of the invention in which an electric lock is used as a locking device.
Figure 6B:
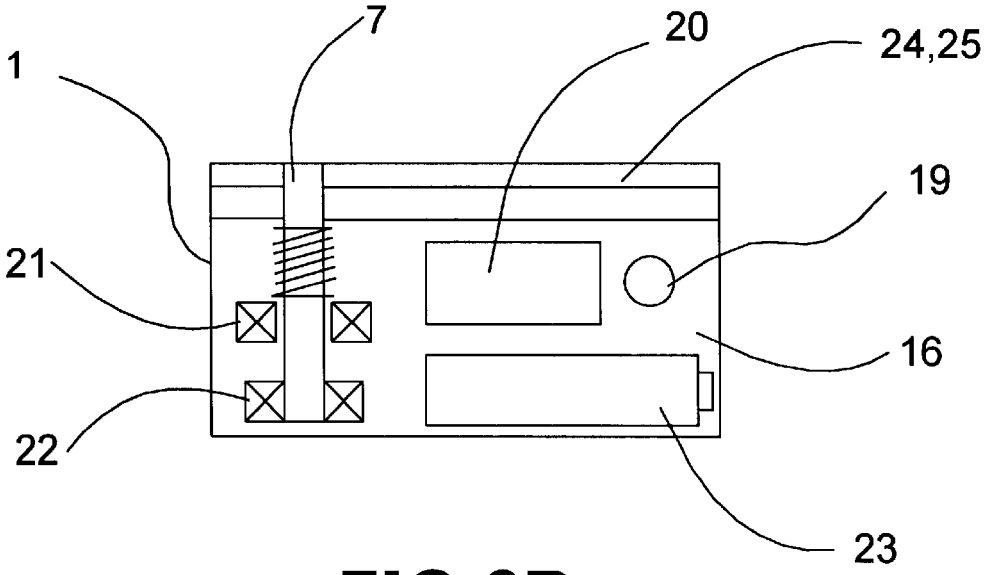
FIG. 6B is a side view showing the inside of the locking device corresponding to FIG. 6A.

Turning to FIG. 6A, therein is shown one preferred embodiment of the invention where an electric lock is used as a locking device 1. FIG. 7B shows the inside components of the locking device 1. If a signal receptor 19 receives key code signal, a chip 20 activates solenoids 21, 22 with DC power from a battery 23 and actuates a locking bar 7. All these elements are installed in a lock housing 16. The lock housing 16 is fixed to the frame 2 firmly by the coupling of attachment rails 24, 25 and equipment rails 17, 18 respectively.

Figure 7A:
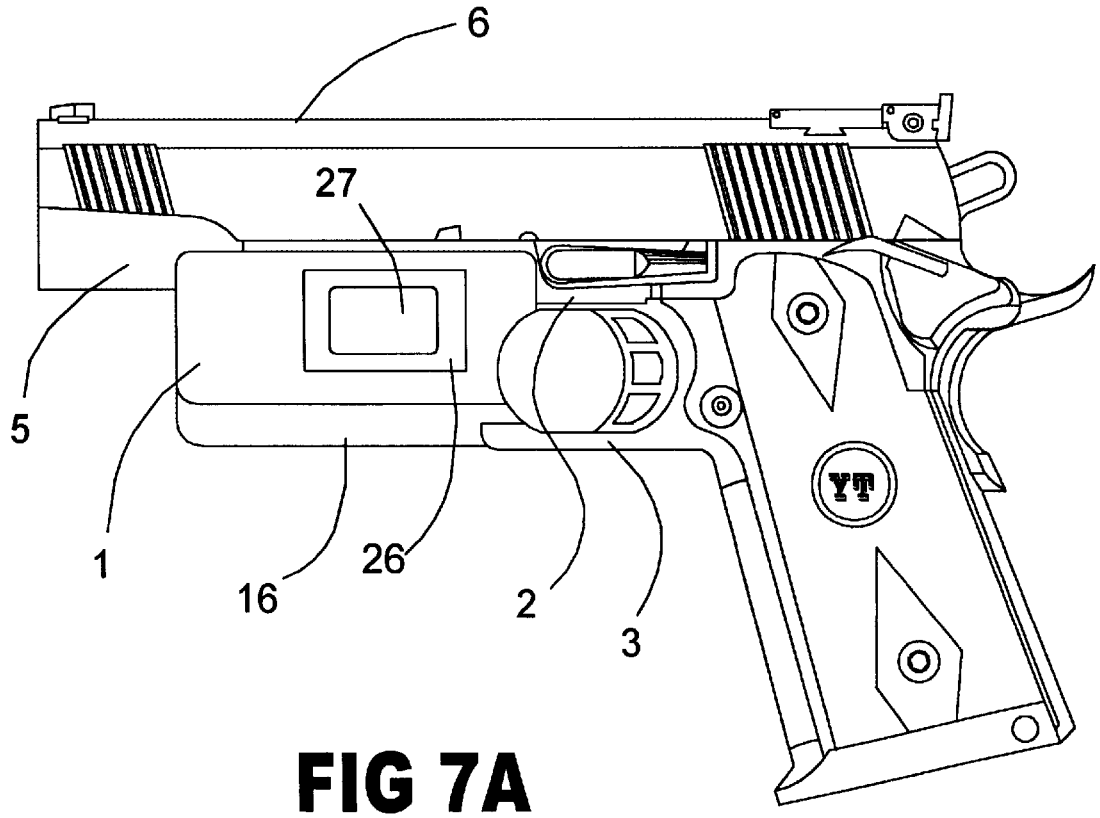
FIG. 7A is a side view showing one embodiment of the invention in which an biometrick lock is used as a locking device.
Figure 7B:
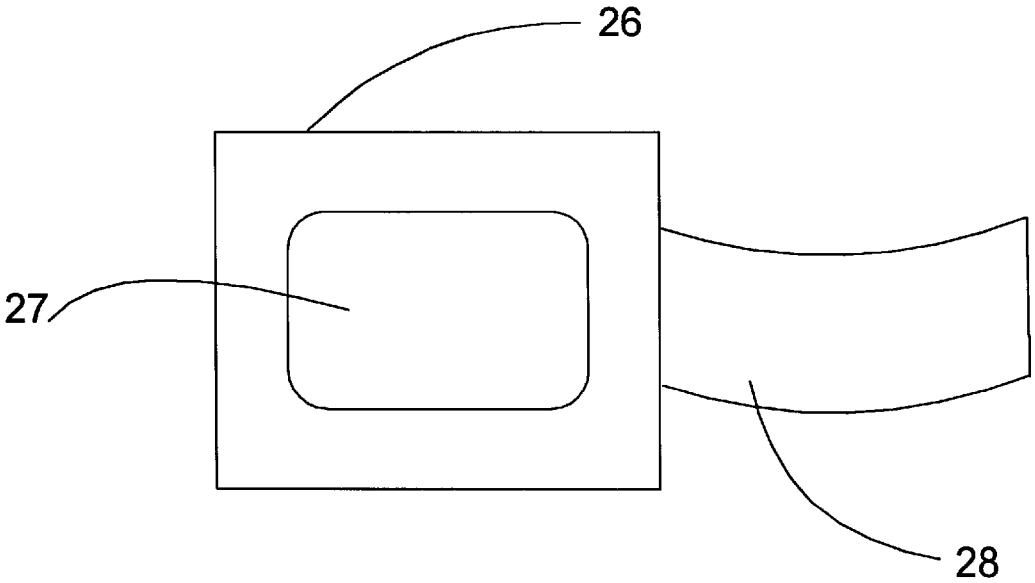
FIG. 7B is a plan view showing one embodiment of a biometrick CMOS sensor corresponding to FIG. 7A.

Turning to FIG. 7A, therein is shown one preferred embodiment where a biometric lock is used as a locking device 1. In this embodiment, a fingerprint authentication is used. A biometric CMOS sensor 26 for fingerprint authentication is installed in a locking device 1. Any other biometric authentication can be used for a locking device 1 it its components can be installed in the lock housing 16. You need not remember key code information. However, it requires a certain amount of space. If it is embedded in a handgun, the original design of the handgun must be changed drastically. This is one of the main reasons why there has been no biometric lock realized for an actual handgun. However, in this embodiment according to the present invention, the biometric CMOS sensor 26 is installed in a lock housing 16 and attached outside of the pistol 6. Hence there is no impact on the inside of the pistol 6. FIG. 7B shows an example of a biometric CMOS sensor 26 which can be used for a fingerprint authentication of the present invention. It is very quick and reliable. The biometric CMOS sensor 26 has integrated liferecognition capability based on measurement of human body capacitance and blood oxygen level Therefore, even if a copy of a fingerprint is placed on the fiber-optic surface 27 of the biometric CMOS sensor 26, it can reveal the fake fingerprint. Electric consumption is also very small. Reference numeral 28 denotes signal and power cables.

Preferred embodiments of the secured firearm in the case of a revolver type handgun according to the present invention will be described hereunder with reference to FIG. 8 through FIG. 14.

Figure 8:
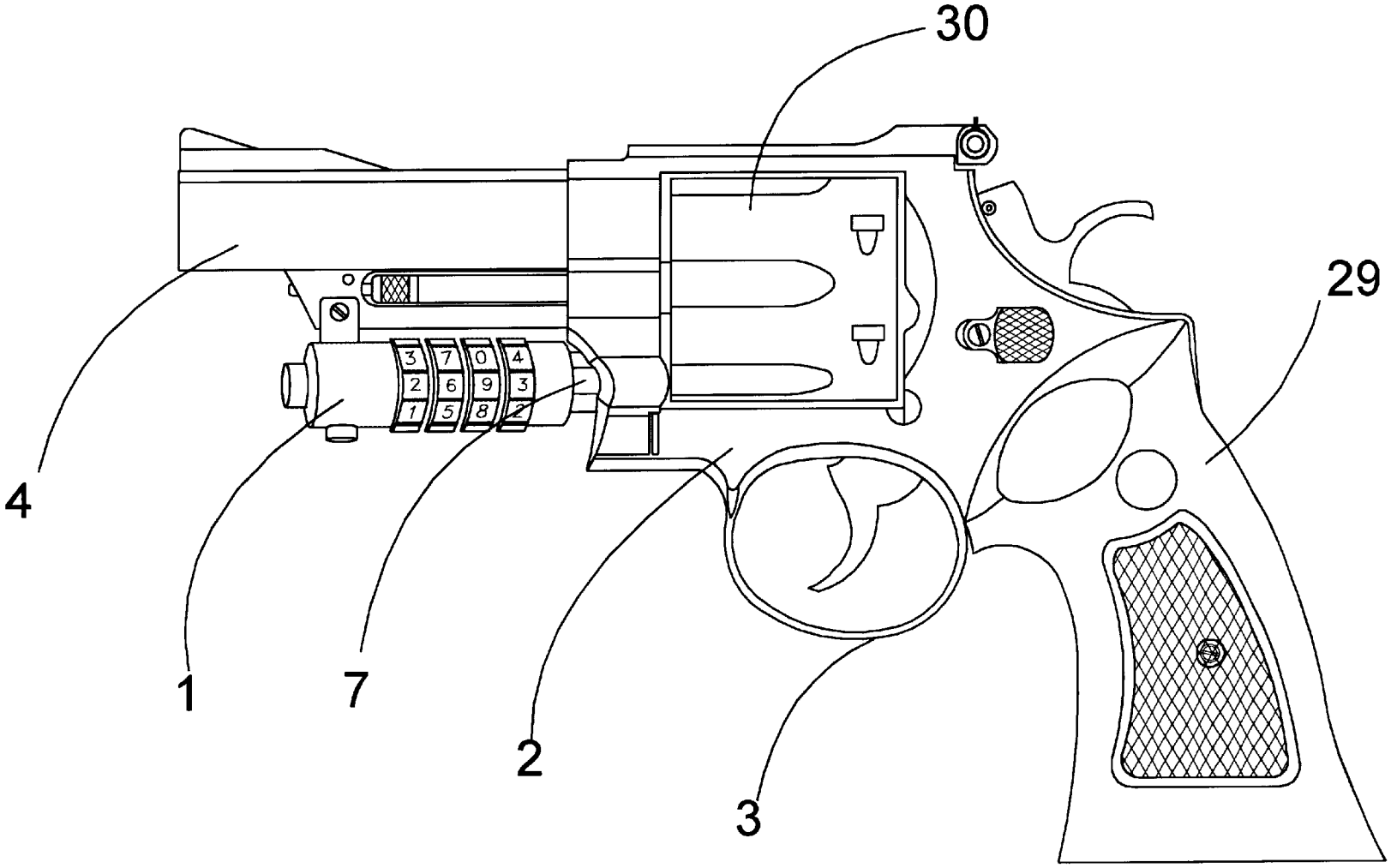
FIG. 8 is a side view showing one embodiment of a secured firearm in the case of a revolver according to the present invention.

Referring to FIG. 8, therein is shown a side view of one preferred embodiment of the present invention in the case of a revolver type handgun where a locking device 1 is fix to a frame 2 in front of a trigger guard 3 and under a barrel 4. In this embodiment, a combination lock is used as a locking device 1. Any other kind of lock can be used as a locking device 1. In the locked situation, the locking bar 7 is inserted into a hole of a cylinder 30 and it restricts the movement of the cylinder 30. Said hole is not shown in the view. In the case of a revolver, bullet chambers of the cylinder 30 can work as the hole where the locking bar 7 is inserted. The locking bar 7 is horizontal in the case of a revolver, which is vertical in the case of a pistol. In the locked situation, the cylinder 30 is fixed by the locking bar 7 and it can neither rotate nor swing out. If the cylinder 30 cannot rotate, the revolver 29 is disabled. Only if the set of 4 figures is ordered correctly, the locking bar 7 can be withdrawn and the locking device 1 is changed into unlocked situation. Even in unlocked situation, if the set of 4 figures is changed, the locking bar 7 cannot be inserted. This can prevent inadvertent insertion of the locking bar 7 when the revolver 29 is in operation. This can also prevents the disclosure of the hidden set of 4 figures when the revolver 29 is in operation.

Figure 9:
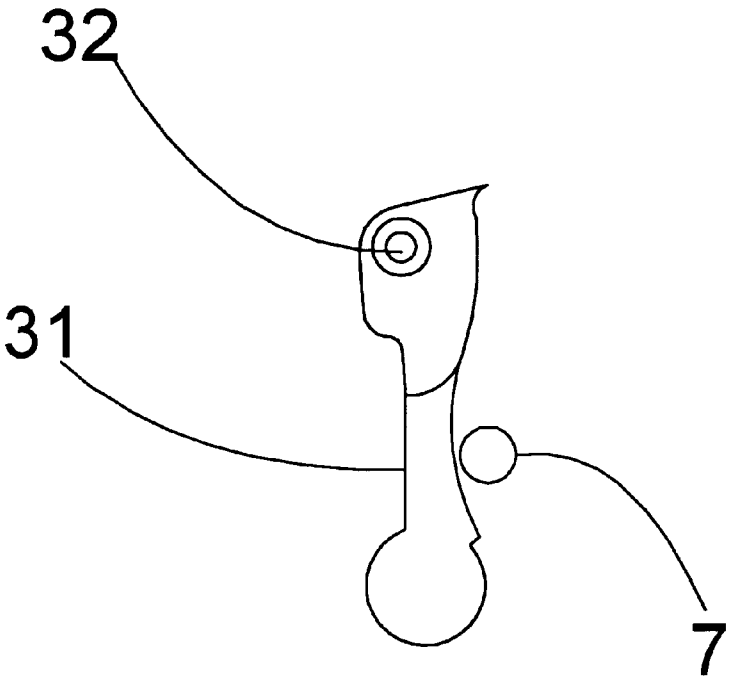
FIG. 9 is a front view of a current yoke which supports a cylinder by way of a cylinder rod.

Referring to FIG. 9, therein is shown a front view of a current yoke 31 which supports a cylinder 30 by way of a cylinder rod 32. The current yoke 31 has a straight arm.

Figure 10:
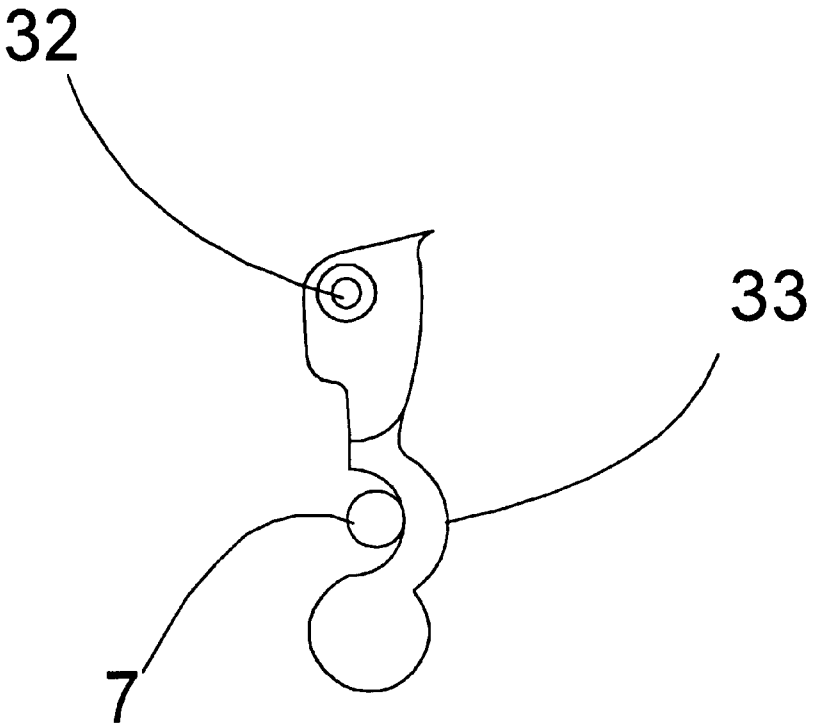
FIG. 10 is a front view showing a curved yoke which also supports a cylinder by way of a cylinder rod according to the present invention.

Referring to FIG. 10, shown is a front view of a curved yoke 33 which also supports a cylinder 30 by way of a cylinder rod 32 according to the invention. If a current yoke 31 is used, the locking bar 7 must pass outside of the current yoke 31. In this case the locking bar 7 might be cut from outside and the locking device 1 loses its function. If a curved yoke 33 according to the present invention is used, the locking bar 7 can be covered with the curved yoke 33, and no one can cut the locking bar 7 from outside.

Figure 11A:
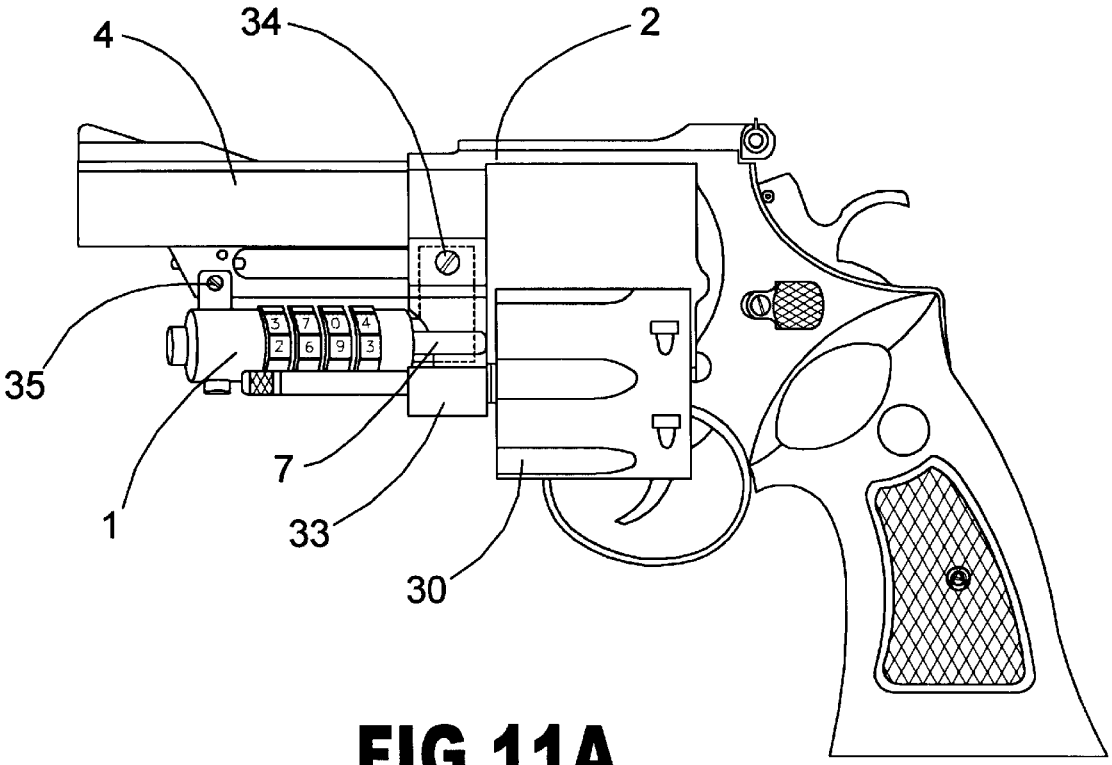
FIG. 11A is a side view showing the way by which a locking device is mounted permanently on a frame of a revolver according to the present invention.

Referring to FIG. 11A, therein is shown the way how to fix the locking device 1 to the frame 2. As can be seen, an inner screw 34 fixes the locking device 1 from the inside of the frame 2. Normally, a cylinder 30 is installed in the frame 2 and a curved yoke 33 covers the inner screw 34. Therefor, in order to tighten or loosen the inner screw 34, you need to swing out the curved yoke 33 at first. In order to swing out the curved yoke 33, you need to swing out the cylinder 30, too. In order to swing out the cylinder 30, the locking device 1 must be released and the locking bar 7 must be withdrawn. If the locking device 1 is in the locked position, the locking bar 7 is inserted into the cylinder 30 and you cannot swing out the cylinder 30. You need to know the key code information to access the inner screw 34. Therefor, you can never dismantle the locking device 1, unless you know the hidden key code for the locking device 1. A screw 35 also fixes the locking device 1 to the frame 2 under the barrel 4.

Figure 11B:
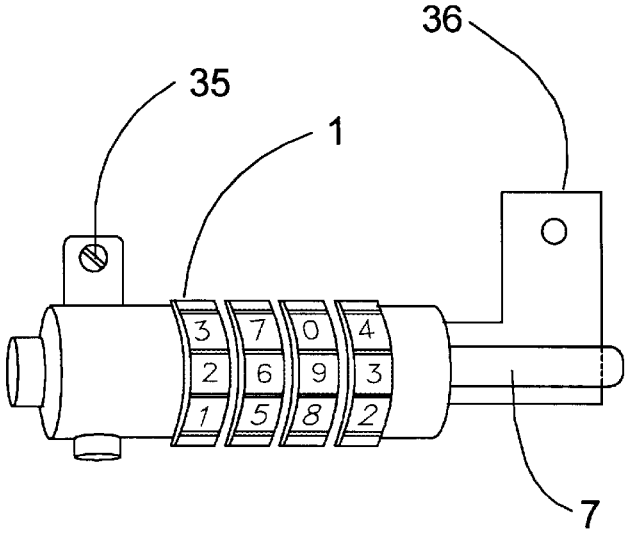
FIG. 11B is an enlarged side view showing a locking device which is mounted on a frame of a revolver corresponding to FIG. 11A.

Referring to FIG. 11B therein is shown the side view of the locking device 1. An arm 36 connects the locking device 1 to the frame 2.

Figure 11C:
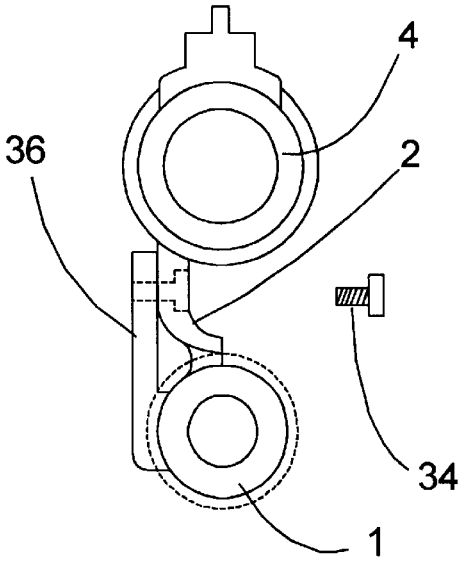
FIG. 11C is a front view showing the way by which a locking device is mounted permanently on a frame of a revolver corresponding to FIG. 11A.

Referring to FIG. 11C, therein is shown the front view of the locking device 1. The inner screw 34 fixes the locking device 1 by way of the arm 36 from the inside of the frame 2.

Figure 12A:
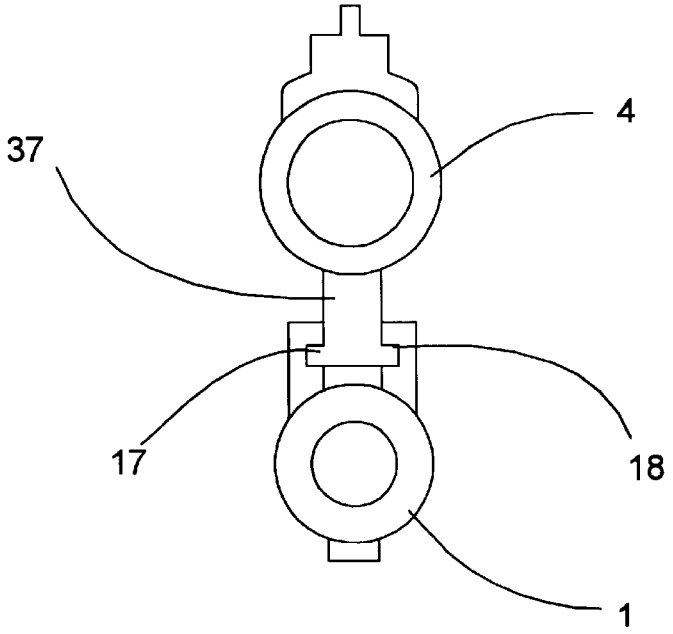
FIG. 12A is a front view showing the front end of a revolver which has equipment rails on the both sides of a cylinder rod shroud. A locking device can be firmly connected on the equipment rails in the case of newly designed revolvers.
Figure 12B:
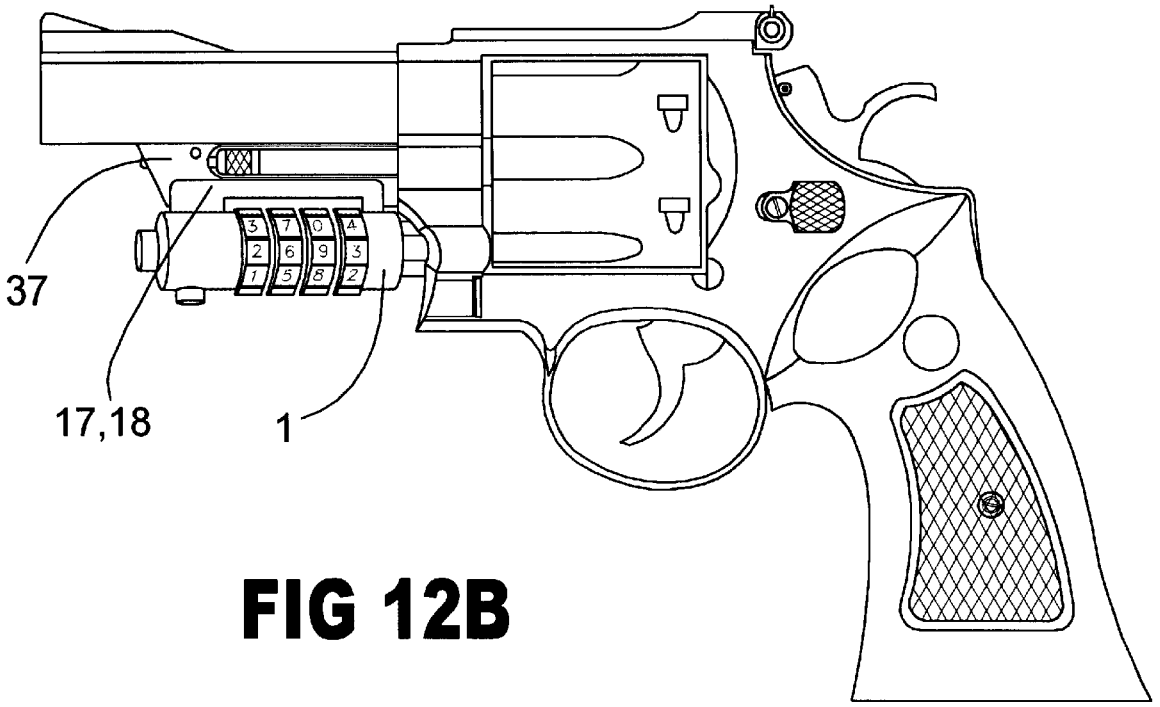
FIG. 12B is a side view showing one embodiment of the invention corresponding to FIG. 12A.

Referring to FIG. 12A, therein is shown a front view of one preferred embodiment for a newly designed revolver where a locking device 1 is mounted on equipment rails 17, 18. In this embodiment, the equipment rails 17, 18 are built on a cylinder rod shroud 37. The locking device 1 can be firmly fixed on the equipment rails 17, 18. FIG. 12B shows a side view of the preferred embodiment where the locking device 1 is firmly fixed on the equipment rails 17, 18 corresponding to FIG. 12A.

Figure 13A:
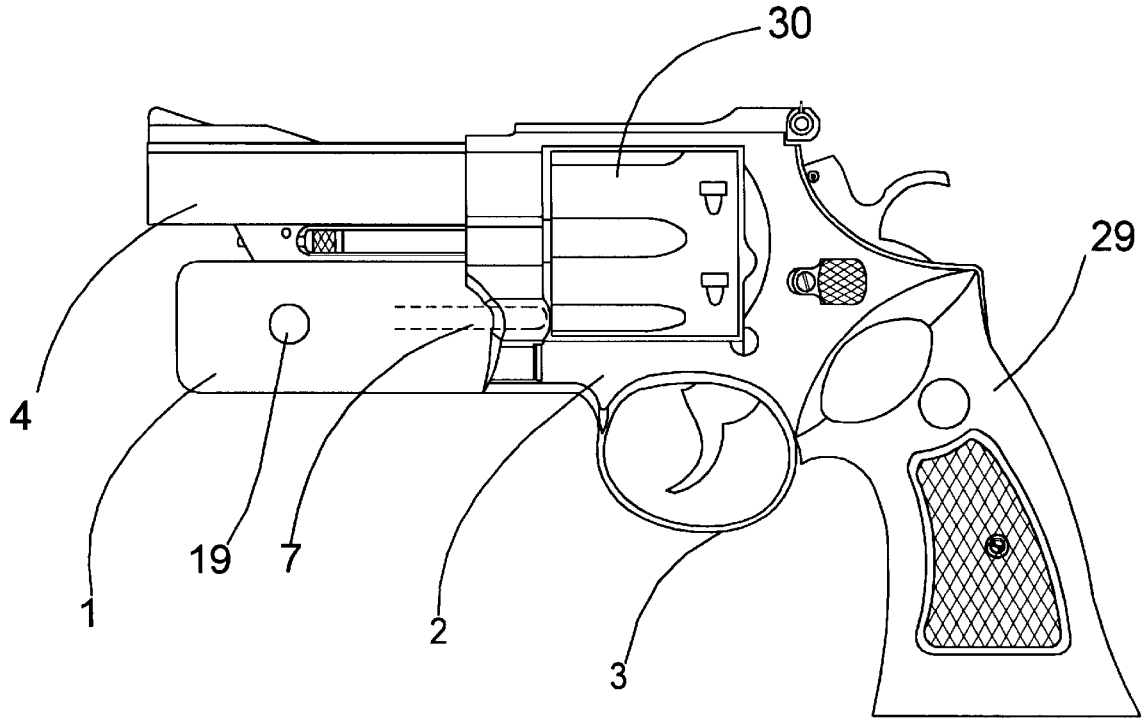
FIG. 13A is a side view showing one embodiment of the invention where an electric lock is used as a locking device.
Figure 13B:
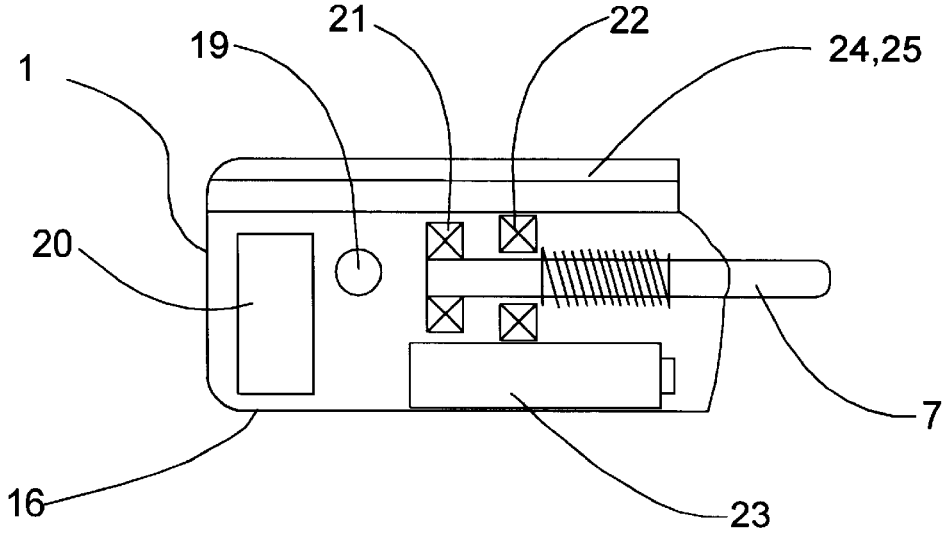
FIG. 13B is an enlarged side view of a locking device which uses an electric lock corresponding to FIG. 13A.

Turning to FIG. 13A, therein is shown one preferred embodiment of the invention where an electric lock is used as a locking device 1. Basic concept is the same as the case of a pistol which is shown in FIG. 6A. In the case of a revolver, a locking bar is horizontal. In order to avoid unauthorized dismantling, you can weld the lock housing 16 to the frame 2. You can also make an extended frame which originally include the lock housing 16. FIG. 13B shows the inside components of the locking device 1. If a signal receptor 19 receives key code signal, a chip 20 activates solenoids 21, 22 with DC power from a battery 23 and actuates a locking bar 7. All these elements are installed in a lock housing 16. The lock housing 16 is fixed to the frame 2 firmly by the coupling of attachment rails 24, 25 and equipment rails 17, 18 respectively.

Figure 14:
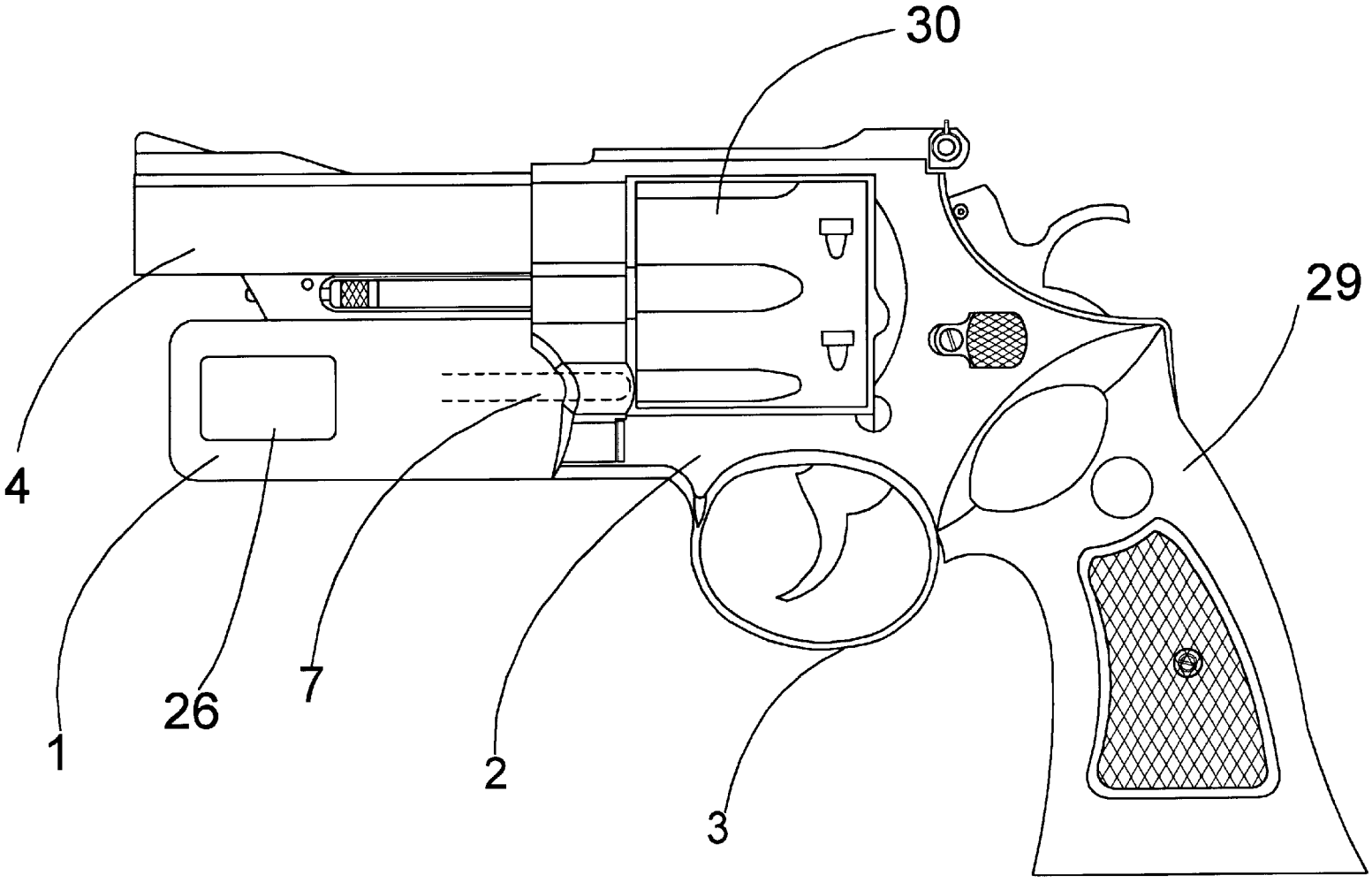
FIG. 14 is a side view showing one embodiment of the invention where a biometric lock is used as a locking device.

Turning to FIG. 14, therein is shown one preferred embodiment where a biometric lock is used as a locking device 1. In this embodiment, a fingerprint authentication is used. A biometric CMOS sensor 26 for fingerprint authentication is installed in a locking device 1. Any other biometric authentication can be used for a locking device 1 if its components can be installed in the lock housing 16. Basic concept is the same as the case of a pistol which is shown in FIG. 7A. In the case of a revolver, a locking bar is horizontal.

What I claim as my invention is:

1. A secured firearm comprising:

a pistol having a slide on a frame;

a locking bar which is to be inserted into the slide in a locked position and withdrawn in a released position;

and a locking apparatus which secures said locking bar in the locked position and which is fixed to the frame in front of a trigger guard and under a barrel, whereby said locking bar restricts the movement of the slide in the locked position and thereby disabling the pistol.

2. A secured firearm comprising:

a revolver having a cylinder in a frame;

a locking bar which is to be inserted into the cylinder in a locked position and withdrawn in a released position;

and a locking apparatus which secures said locking bar in the locked position and which is fixed to the frame in front of a trigger guard and under a barrel, said locking apparatus being fixed to the frame while both in a state of use and in a state of non-use, whereby said locking bar restricts the movement of the cylinder in the locked position and thereby disabling the revolver.

3. A secured firearm according to claim 2, wherein a yoke of the revolver is curved so as to enable the locking bar to be inserted into the cylinder passing through the interior portion of the curve formed on the yoke.

4. A secured firearm according to claim 1 or 2, wherein said locking apparatus is a key lock comprising a key, a locking mechanism and a housing.

5. A secured firearm according to claim 1 or 2, wherein said locking apparatus is a combination lock comprising a plurality of dials and a housing.

6. A secured firearm according to claim 1 or 2, wherein said locking apparatus is an electrical lock comprising a chip, a battery, a sensor, electromagnets, and a housing.

7. A secured firearm according to claim 1 or 2, wherein said locking apparatus is fixed to the frame with screws inserted from the inside of the frame.

8. A secured firearm according to claim 1 or 2, wherein said locking apparatus is fixed to the frame with equipment rails on the frame in front of the trigger guard.

9. A secured firearm according to claim 1 or 2, wherein said locking apparatus is fixed to the frame by welding.

10. A secured firearm according to claim 1 or 2, wherein said locking apparatus is installed in an extended frame in front of the trigger guard.

* * * * *